US005364074A

United States Patent [19]

Gourley

[11] Patent Number: 5,364,074

[45] Date of Patent: Nov. 15, 1994

[54] LATCHING WINCH SUITABLE FOR FLAGPOLES

[76] Inventor: Charles A. Gourley, 12 Grassy Plain Ter., Bethel, Conn. 06801

[21] Appl. No.: 57,567

[22] Filed: May 6, 1993

[51] Int. Cl.[5] ..... B66D 5/20; B66D 5/06

[52] U.S. Cl. ..... 254/375; 192/800 R

[58] Field of Search ..... 254/375, 378, 379, 376; 192/7, 8 R

[56] References Cited

U.S. PATENT DOCUMENTS

| | | | |
|---|---|---|---|
| 1,408,209 | 2/1922 | Kleber | 254/375 |
| 2,339,232 | 1/1944 | Moroney | 192/8 R |
| 2,660,902 | 12/1953 | Wagner | 192/8 R |
| 2,873,832 | 2/1959 | Helm | 192/8 R |
| 3,024,884 | 3/1962 | Sieber | 192/8 R |
| 3,414,095 | 12/1968 | Kalns | 192/8 R |
| 3,976,172 | 8/1976 | F'Geppert | 192/8 R |
| 4,236,618 | 12/1980 | West | 192/8 R |
| 4,280,605 | 7/1981 | Papadopoulos | 192/8 R |
| 4,413,713 | 11/1983 | West | 192/8 R |

*Primary Examiner*—Katherine Matecki
*Attorney, Agent, or Firm*—Dallett Hoopes

[57] ABSTRACT

A latching winch comprises a spool having a drive pin offset from the axis and extending out from one side. A drive/latch assembly comprises a drive plate formed with an opening coaxial with the spool and carrying in the opening a bushing having internal crank-engaging opening and a lateral drive lug spaced from the bushing. A pair of mirror-image pawl plates are stacked sidewise each having against the drive plate, the pawl plates each having an aperture in one end pivotally receiving the spool drive pin, a central opening loosely receiving the bushing and pawl detents extending outward, the pawl plates having projections, on the other end, the projections being disposed on opposite sides of and being adapted to be selectively engaged by the drive lug on the drive plate. A spring biases the pawl plates with their pawl detents outward. A stationary ring-gear-like cam is concentric with the axis and surrounds the drive and pawl plates, the cam having inwardly facing peaks and valleys, the cam and detents comprising the latch.

3 Claims, 3 Drawing Sheets

LATCHING WINCH SUITABLE FOR FLAGPOLES

BACKGROUND OF THE INVENTION

1. Field of the Invention

This invention relates to a winch comprising a spool and drive/latching assembly. It offers a positive latching against unreeling when the spool is not being turned. When the spool is rotated through the drive/-latching assembly, as by a crank, the latch is automatically retracted. This arrangement is superbly suited as a flagpole winch.

2. Description of Related Art including Information Disclosed under §§1.97 to 1.99

In the past winches such as are used on flagpoles have included braking devices. Examples are shown in the two Joe West U.S. Pat. Nos. 4,236,618 issued Dec. 2, 1980 and 4,413,713 issued Nov. 8, 1983. The unintended unreeling of such winches is prevented by a pair of brake shoes which are eased off the inside of a drum adjacent the spool by a yoke which is moved when the crank is rotated.

A problem with such prior devices is that brake shoes have occasionally failed and the flag, as a consequence, has slipped down to half mast, for instance. It must be remembered that the force on a flag halyard in a stiff breeze can approach 100 pounds and this has often been simply too much for the brake shoes to deal with. Additionally, ill-advised maintenance crews have lubricated the brake-shoe-type winches which, of course, has resulted in the shoes becoming slippery and ineffective to stop the turning of the winch.

SUMMARY OF THE INVENTION

The present invention is a latching winch comprising a winch spool having an offset drive pin extending out from one side of the spool, and a drive/latch assembly adjacent the spool. The assembly comprises a drive plate formed with an opening coaxial with the spool and carrying in the opening a bushing having an internal crank-engaging means and a lateral drive lug spaced from the bushing. The assembly also comprises a pair of mirror-image pawl plates stacked sidewise against the drive plate, the pawl plates each having an aperture in one end pivotally receiving the spool drive pin and a central opening loosely receiving the bushing.

Spaced from the drive pin the pawl plates carry pawl detents extending in opposite directions outward, the pawl plates being formed on the opposite ends from the drive pin with projections, the projections straddling and being adapted to be selectively engaged by the lateral drive lug on the drive plate. Spring means bias the pawl plates with their pawl detents outward. A stationary ring-gear-like cam is concentric with the axis and surrounds the drive and pawl plates, the cam having inwardly facing peaks and valleys. Means are provided to rotatably support the bushing and spool.

BRIEF DESCRIPTION OF THE DRAWINGS

Further objects and features of the invention will be apparent from the following specification and a study of the accompanying drawings, all of which disclose a non-limiting embodiment of the invention. In the drawings.

DESCRIPTION OF THE PREFERRED EMBODIMENT

Figure 1:
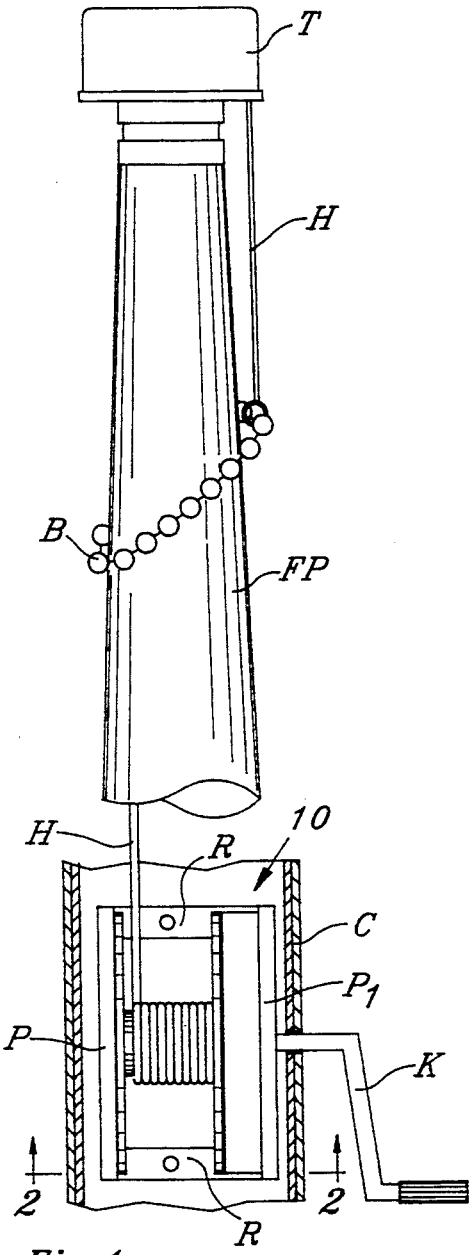
FIG. 1 is a fragmentary broken view of a flagpole having a winch of the invention installed therein. The upper portion of the view is in profile while the lower portion is in section.

A flagpole of the concealed halyard variety is shown in FIG. 1 and generally designated FP. It comprises a hollow column C having a rotatable truck assembly T at its upper end. The halyard H is strung from the winch up through the truck over its pulleys (not shown) and downward, its end being attached to a line of weighted beads B which encircle the pole. Flag-holding clips (not shown) are disposed as is conventional on the halyard H between the line of beads B and the truck assembly T.

A winch 10 embodying the invention is disposed inside the column accessible through a door. The winch comprises a pair of vertical parallel spaced side plates P and P1 held in spaced relation by bridging ribs R which are bolted to the inside of the column. The column is apertured to pass the driving end of the crank K. The access door (not shown) is provided in the wall of the hollow column C to permit servicing of the winch assembly.

Figure 2:
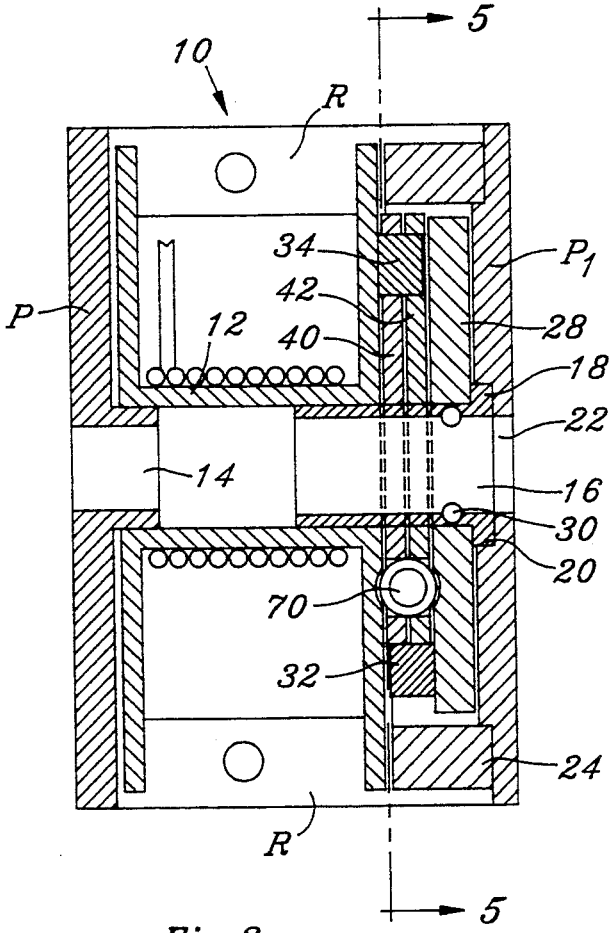
FIG. 2 is an enlarged sectional view through a central line vertical plane on the axis of the winch enlarged from FIG. 1.

The winch assembly is shown in section in FIG. 2. It comprises a metal spool 12 having the conventional side plates and a central winding drum. The lefthand end of the spool is rotatably supported on a bushing 14 secured in the side plate P. The right hand end of the spool is supported on an elongate bushing 16 which is, of course, tubular and at its rightward end has an outward flange 18 which rides in a relieved portion 20 of opening 22 in the side plate P1. The inner end of the bushing 16 rotatably receives the opening in the rightward end of the spool 12 while the inward end of the bushing 14 is, as stated, rotatably received into the opening in the lefthand end of the spool 12. This journals the spool for rotation.

To end plate P1 is secured a fixed cam 24 (FIG. 4) which is circular similar to a ring gear. As shown, the opening in the cam 24 is formed with gentle peaks and valleys 26 (FIG. 4) as will be described hereunder.

Figure 3:
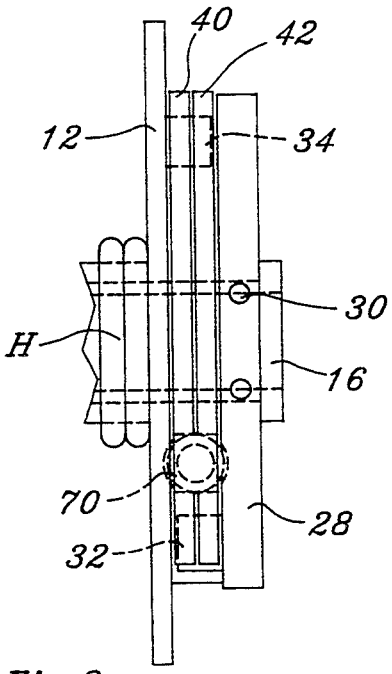
FIG. 3 is a side view simplified and enlarged from FIG. 2 showing only the winch drive-transmission parts, the surrounding cam with pawl detents having been removed.

Secured to the bushing 16 adjacent its flange 18 (FIG. 3) is the drive plate 28. It is secured by means of spaced parallel pins 30 which extend transversely through holes in the plate and the bushing. The pins not only secure the two parts together but also cut down the inside of the bushing providing parallel keying surfaces which are snugly engaged by the square end of the crank K during the rotation of the crank. This structure keys the inserted crank stem and the bushing together for rotation. The pins also assure that the bushing 16 and the drive plate 28 rotate together about the axis of the bushing. A drive lug 32 extends from the inner surface of the drive plate 28 parallel to the axis of the bushing.

The righthand end plate of the spool 12 is formed with drive pin 34 which is parallel to and offset from the axis of the spool and the axis of the bushing 16 as well.

Mirror-image pawl plates 40 and 42 are provided. Each plate at its upper end (FIG. 4) is formed with an opening 44, 46. At its lower or opposite end each plate is provided with a downward projection 48, 50 which, when the plates 40 and 42 are placed against each other with their openings 44 and 46 receiving pivotally the pin 34 present the opposed inwardly facing coves (FIG. 5). These between them receive the drive lug 32.

In their central portions the pawl plates 40, 42 are formed with enlarged openings 52, 54 which, in assembly, receive the bushing 16. These openings 52, 54 may be somewhat oblong to provide a limited pivotal motion of the plates 40, 42 about the pin 34 to accommodate the movement of the plates as they ride about the peaks and valleys 26 of cam 24.

At about the level of the openings 52, 54, the plates are formed oppositely outward as shown with pawl roller C-shaped cutouts 56, 58. These cutouts more than half encircle respectively a pair of rollers 60, 62 so as to loosely trap the rollers 60, 62 thereinside (FIG. 5).

Below the central openings 52, 54 the respective plates 40, 42 are formed with arcuate cutouts 64, 66 and a coil spring 70 is, in assembly, disposed compressively in the cutouts 64, 66, its ends butting respectively against the closer of the end surfaces comprising the cutouts 64, 66.

Figure 4:
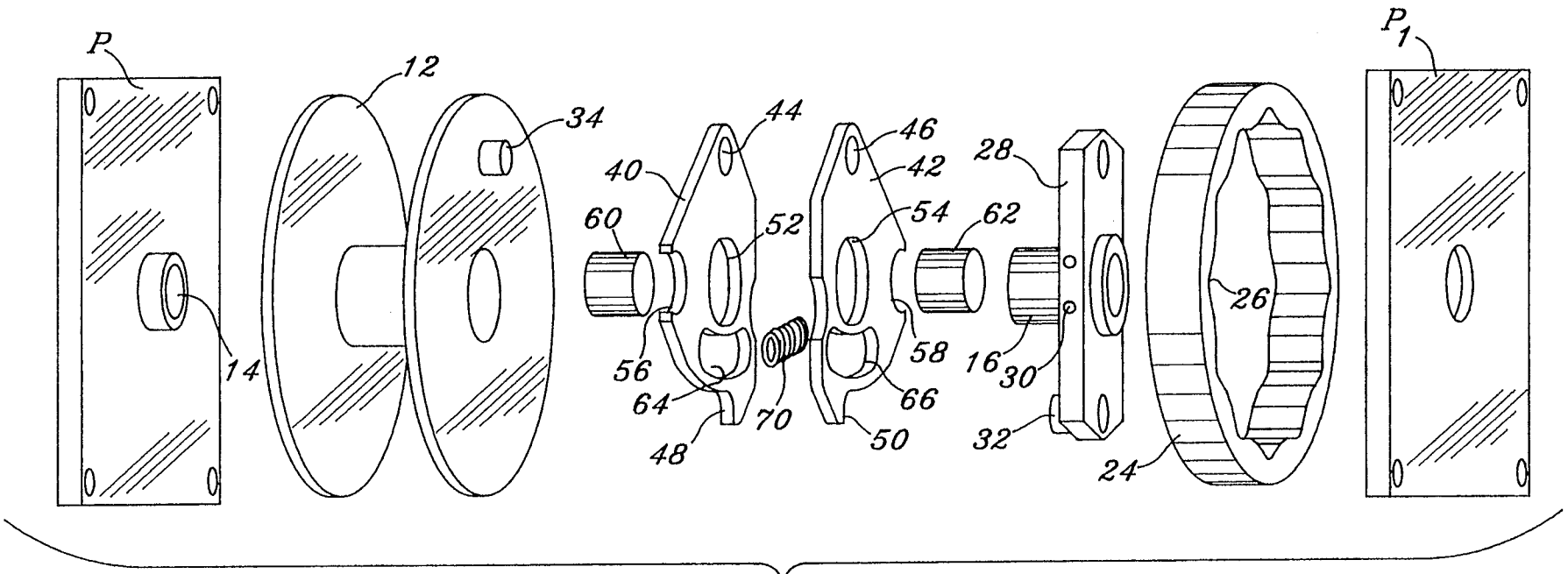
FIG. 4 is a perspective exploded view showing the parts of the assembly lined up in their proper order.
Figure 5:
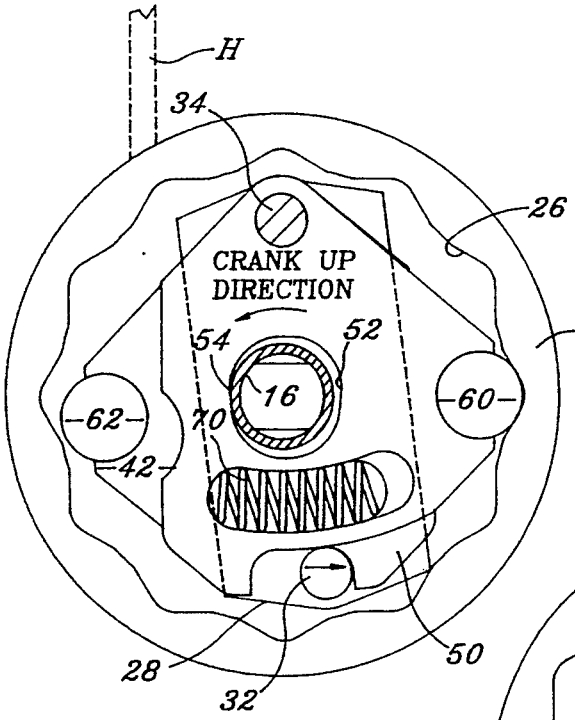
FIG. 5 is an enlarged view taken on the line 5—5 of FIG. 2 and showing the latch assembly as it would appear during the cranking up of a flag.

With the parts assembled from the exploded view of FIG. 4, it will be clear that the pawl plates 40 and 42 ride against each other, their apertures 44, 46 receiving the spool drive pin 34 and their openings 52, 54 receiving the bushing 16 in loose fit. The drive plate 28 (FIG. 3) is anchored to the bushing 16 by the pins 30 so that when the crank is turned, as explained, the drive plate 28 rotates about the axis of the bushing.

In rotation, as when the crank K is turned, the lug 32 of the drive plate 28 engages one of the projections 48, 50 on the pawl plates 40, 42 and as rotation continues causes the pawl plate to be turned about bushing 16 to turn the spool by the drive pin 34. In this manner the rotary motion of the crank is transmitted to the spool.

Figure 6:
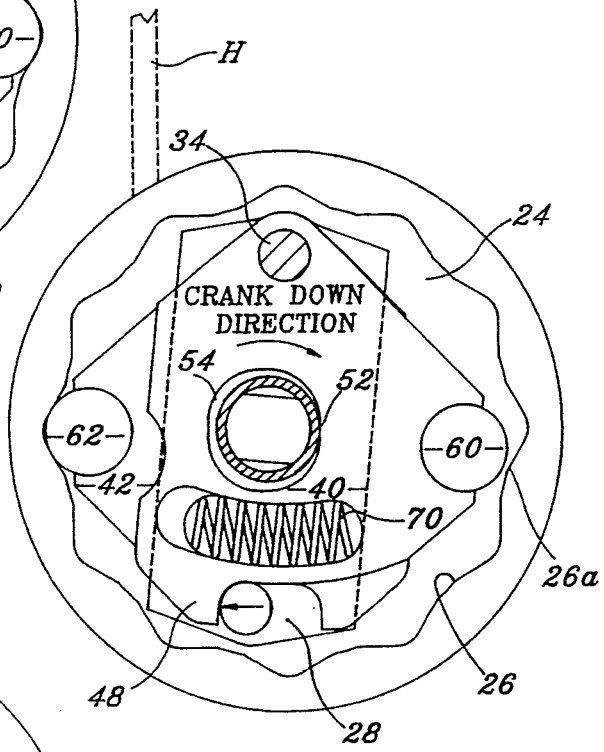
FIG. 6 is a view similar to FIG. 5 showing the latching assembly during the cranking down of the flag.
Figure 7:
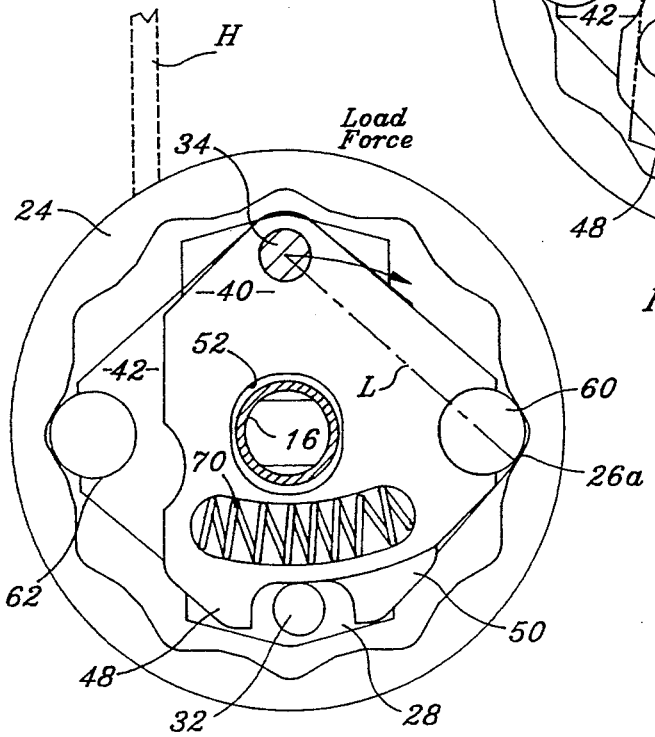
FIG. 7 is a fragmentary view of a portion of FIG. 6 showing the relationship between the spool drive pin, a pawl detent or roller and a cam valley with a flag on the halyard and the mechanism at rest but latching the winch so that the flag stays up.

The transmission of the rotary cranking force having been described, attention will now be focused on the latching means. It is assumed that the pull of the halyard tending to unreel or "unspool" the halyard is forced in a direction clockwise as shown by the arrow in FIG. 7. To help visualize the load better, the halyard H has been inserted in FIGS. 5–7 to show which side of the spool it comes off. Of course the halyard is actually on the other side of section line 5—5 of FIG. 2

With the crank and spool at rest, spring 70 urges the two pawl plates to spread outward causing the roller 60 to nestle in latched position in a valley **26*a* in the cam 24. A straight line L (FIG. 7) drawn from the center of the spool drive pin 34 through the center of the pawl roller 60 indicates the force line generated by the pin 34 toward the roller. Where this line meets the cam, the valley floor 26*a*** is normal; that is, 90° to the line (angle "A").

This relationship makes it possible when the crank is turned to lower the flag (FIG. 6) for the drive lug 32 on the drive plate 28 to engage the projection 48 to shift the plate 40 inward. This moves the roller 60 inward out of its nestled position in the cam valley **26*a*. Continuing, (FIG. 6) the plate 40 is drawn in until the rightward end of the opening 52 engages the bushing 16. As the drive plate continues to rotate about the axis of the bushing 16, there is effected a kind of prying action where the projection 48 is being driven around and the plate moves in a kind of pivoting action about the bushing 16 prying the spool drive pin 34 around with it. This causes the rotation of the spool in the same direction as the drive plate 28** is turning, lowering the flag.

As it moves around, the spool drive pin 34 drags with it the plate 42, the roller 62 moving along the contours 26 of the cam and offering no resistance. This movement of the pawl roller 62 along the peaks and valleys of the inside of the cam makes a "click-click-click" noise which is unoffensive, particularly so because the flagpole is outdoors and the noise is muffled, being inside the column C and is indicative of the mechanism working.

When the flag is next raised, the drive plate 28 will be turned in the opposite direction (FIG. 5) and the drive lug 32 on the drive plate will engage the projection 50. This will cause the roller 62 to be drawn out of its valley so that it will not interfere with the rotation of the assembly. In the cranking, the under pawl plate 42 is moved counterclockwise (FIG. 5) as opening 54 moves rightward and its lefthand margin stops against bushing 16. Again in a prying kind of action, a pivot with the bushing as fulcrum, this moves pin 34 counterclockwise (FIG. 5), raising the flag. During this time, of course, the spring 70 will cause the opposite roller 60 to "click-click-click" as it is dragged along the cam.

When the turning of the crank is stopped (FIG. 7) at any point, the spring 70 will urge both plates 40, 42 outward so that the rollers 60 and 62 engage the cam and the roller on the side of the spool drive pin 34 toward which the halyard tends to rotate the spool nestles into the adjacent valley, for instance **26*a*, to hold the spool against the force of the flying flag. The "at rest" situation in FIG. 7** exists, and exists until the next time the crank is turned.

Because the weight of the flag causes a force in the clockwise direction only (FIG. 7), roller 62 is never engaged in latching. The latching pawl 42, therefore, is at all times idling around. The reason for having two pawls is basically so that the other pawl roller 62 will become the active pawl if the winch is mounted in reverse or if the halyard is wound in the opposite direction on the spool. The second pawl is also of value in forming a backup for the spring 70 to ensure that the working pawl roller 60 is at all times urged outward.

Most parts of the winch may be made of aluminum, but because of wear expected, the pawl plates 40, 42 are of stainless steel. Most parts could be made of stainless steel if desired or necessary, but the rollers will be of bronze material.

Connection of the end of the halyard to the spool may be in the conventional manner.

By virtue of this described invention, a simple flagpole winch is provided with automatic latching means which effects a positive stop, assuring that the flag will stay at the top of its pole when it is supposed to. This is true irrespective of whether bad maintenance results in the oiling of the parts. As a matter of fact, it is desirable to occasionally oil the parts of the winch of the invention as with most other machinery.

It will be seen that a winch having the characteristics and structure shown can be useful on non-flagpole installations. For instance, the winch may be used to control the lift lines on a pair of davits as for raising a small boat. Package hoists and winches on boat trailers are suitable applications. The winch may even be motorized with the drive connected directly to the bushing 16 for driving drive plate 28. Other uses will occur to those skilled in the art.

It should be understood that the invention is not limited to the embodiment shown but the invention is instead defined by the scope of the following claim language, expanded by an extension of the right to exclude as is appropriate under the doctrine of equivalents.

What is claimed is:

1. A latching winch comprising:

a. a winch spool having an axis and a drive pin extending outward from one end of the spool and parallel to and spaced from the axis, b. a drive/latch assembly adjacent the spool and comprising:

1) a drive plate formed with an opening coaxial with the spool and fixedly carrying in the opening a bushing adapted to be driven by a crank and having a lateral drive lug secured to the plate at a position spaced from the bushing, 2) a pair of mirror-image pawl plates overlapping each other and positioned against the drive plate, the pawl plates each having an aperture in a first end pivotally receiving the spool drive pin, a large central opening loosely receiving the bushing, pawl means outward from the large openings on opposite edges of the respective plates, the pawl plates being formed opposite the first ends with projections, the projections being disposed respectively on opposite sides of and being adapted to be selectively engaged by the lateral drive lug on the drive plate, and the pawl plates having opposed spring-engaging surfaces respectively, 3) a spring compressively disposed between the spring-engaging surfaces urging the respective pawl plates outward, and 4) a stationary ring-gear-like cam concentric with the axis and surrounding the drive and pawl plates and having inwardly facing alternate peaks and valleys, whereby the spring urges the pawl plates outward with the pawl means on at least one of the pawl plates engaging a valley in the cam to latch the rotation of the spool in one direction, and, when the bushing is cranked, the lug on the drive plate will engage the projection on the said pawl plate to retract said pawl means out of the valley and that pawl plate will be fulcrumed about the bushing to crank the drive pin and rotate the spool, and when the cranking stops, the said pawl plate will move outward and its pawl means will engage the cam.

2. A latching winch as claimed in claim 1 wherein the pawl plates are formed with C-shaped outwardly facing openings and the openings receive rollers respectively and portions of the rollers exposed outwardly comprise the pawl means.

3. A latching winch comprising:

a. a winch spool having an axis and a drive pin extending outward from one end of the spool and parallel to and spaced from the axis, b. a drive/latch assembly adjacent the spool and comprising:

1) a drive plate formed with a central tubular bushing adapted to be driven by a crank and a lateral drive lug secured to the plate at a position spaced from the bushing, 2) a pair of side-by-side overlapping pawl plates positioned against the drive plate, the pawl plates each having an aperture in a first end pivotally receiving the spool drive pin, a large central opening loosely receiving the bushing, pawl means on the pawl plates outward of the openings on opposite outward edges of the plates respectively, the pawl plates being formed opposite the first ends with projections, the projections being disposed on opposite sides of and being adapted to be selectively engaged by the lateral drive lug on the drive plate, and the pawl plates having opposed spring-engaging surfaces respectively, 3) a spring compressively disposed between the spring-engaging surfaces urging the respective pawl plates outward, and 4) a stationary ring-gear-like cam concentric with the axis and surrounding the drive and pawl plates and having inwardly facing alternate peaks and valleys, whereby the spring urges the pawl plates outward with the pawl means on at least one of the pawl plates engaging a valley in the cam to latch the rotation of the spool in one direction, and, when the bushing is cranked, the lug on the drive plate will engage the projection on the said pawl plate to retract said pawl means out of the valley and that pawl plate will be fulcrumed about the bushing to crank the drive pin and rotate the spool, and when the cranking stops, the said pawl plate will move outward and its pawl means will engage the cam.

* * * * *